United States Patent [19]

Bivins, Jr.

[11] 3,986,846

[45] *Oct. 19, 1976

[54] FUEL SUPPLY APPARATUS

[76] Inventor: Henry W. Bivins, Jr., 5030 Brummel, Skokie, Ill. 60076

[ * ] Notice: The portion of the term of this patent subsequent to May 13, 1993, has been disclaimed.

[22] Filed: May 30, 1975

[21] Appl. No.: 582,278

Related U.S. Application Data

[63] Continuation of Ser. No. 414,178, Nov. 8, 1973, abandoned.

[52] U.S. Cl. ..... 48/180 C; 48/180 H; 48/196 R; 62/52; 137/100; 261/161

[51] Int. Cl.[2] ..... B01F 3/02

[58] Field of Search ..... 48/102 R, 106, 180 R, 48/180 C, 180 H, 180 P, 190, 191, 196 R; 62/52; 137/88, 100, 100.19, 111, 114; 203/25, DIG. 8; 261/150, 151, 160, 161

[56] References Cited

UNITED STATES PATENTS

| | | | |
|---|---|---|---|
| 1,333,986 | 3/1920 | Lundgaard | 137/100 |
| 1,889,162 | 11/1932 | Thomas et al. | 48/180 C |
| 2,222,551 | 11/1940 | Ziebolz et al. | 137/88 |
| 2,643,944 | 6/1953 | Malir | 137/111 |
| 2,719,080 | 9/1955 | Schmidt et al. | 137/114 |
| 3,233,987 | 2/1966 | Hepburn | 48/180 |
| 3,306,273 | 2/1967 | Dolphin | 48/102 |
| 3,534,753 | 10/1970 | Ollivier | 137/88 |
| 3,658,499 | 4/1972 | Delahunty | 48/196 R |
| 3,762,428 | 10/1973 | Beck et al. | 137/88 |
| 3,883,322 | 5/1975 | Bivins | 48/180 R |

*Primary Examiner*—S. Leon Bashore
*Assistant Examiner*—Peter F. Kratz
*Attorney, Agent, or Firm*—Wegner, Stellman, McCord, Wiles & Wood

[57] ABSTRACT

An apparatus for providing from a supply of liquid fuel fluid a gaseous fuel fluid having a preselected calorific value. The apparatus includes means for vaporizing the liquid fuel fluid into air compressed by a compressor having a closed loop coolant system. A portion of the gaseous fuel fluid delivered from the apparatus is provided as a result of a heat exchange between a portion of the liquid fuel fluid and a coolant fluid utilized for cooling the air compressor. An adjustment means is provided for adjusting the preselected calorific value of the output gaseous fuel fluid as desired. In one form, a cascaded arrangement of means for flashing liquid fuel fluid and providing heat exchange therefrom is utilized to provide the desired gaseous fuel fluid.

23 Claims, 2 Drawing Figures

FUEL SUPPLY APPARATUS

CROSS REFERENCE TO RELATED APPLICATIONS

This application comprises a continuation of my copending application, Ser. No. 414,178, filed Nov. 8, 1973, and now abandoned entitled "Fuel Supply Apparatus."

BACKGROUND OF THE INVENTION

1. Field of the Invention

This invention relates to fluid supply apparatus and in particular to apparatus for providing from a supply of liquid fuel fluid a gaseous fuel fluid.

2. Description of the Prior Art

In the use of a natural gas fuel fluid, such as in industry, it has been found desirable at times to provide an auxiliary fuel supply which may be used either to supplement or replace the natural gas supply.

In my U.S. Pat. No. 3,883,322, issued May 13, 1975, entitled "Blending Apparatus For Vaporizing Propane," I have disclosed an apparatus for providing from a supply of liquefied fuel fluid, such as propane and the like, an aerated, gaseous fuel fluid. The apparatus disclosed therein includes means for vaporizing a portion of the liquid fuel as a result of absorption of thermal energy developed in the process of compressing ambient air to be mixed with the supply fuel fluid in the aeration thereof. The apparatus further includes means for dehumidifying the compressed air utilizing a flashing of another portion of the liquid fuel into the compressed air so as to cool the air and permit subsequent removal of the condensed moisture by a separator apparatus.

In that apparatus, a vaporizer using an external source of heat was utilized to vaporize a portion of the liquid fuel to be mixed with the aerated, gaseous fuel fluid to be delivered to the natural gas main. The apparatus utilized a reboiler in connection with the cooling of the air compressor and utilized an orifice for ratio control of the delivery of liquid fuel fluid from the supply.

The present apparatus comprises a further improved form of such a gaseous fuel fluid providing apparatus obviating the need for such a separate vaporizer.

SUMMARY OF THE INVENTION

The present invention comprehends an improved fuel providing apparatus having means for providing the gaseous fuel fluid at a preselected calorific value.

The means controlling the mixture of air and fuel to provide the desired fuel fluid includes means responsive to the rate of flow of air to a mixing chamber and means responsive to the rate of flow of the gaseous fuel fluid to the outlet of the apparatus. Adjustable means are provided for varying the air flow rate signal to adjust the preselected calorific value of the output fuel.

In one specific embodiment, a diaphragm valve is utilized having a diaphragm responsive at one side to a pressure signal corresponding to the rate of flow of the air to the mixing chamber, and on the other side, to a pressure signal corresponding to the rate of flow of the output gaseous fuel fluid to vary the delivery of liquid fuel from the supply.

The improved apparatus further includes a tube and shell heat exchanger for providing improved utilization of the waste heat from the air compressing means in vaporizing a portion of the liquid fuel for subsequent mixing with the aerated gaseous fuel fluid provided from the mixing chamber. The delivery of liquid fuel to the heat exchanger may further be controlled by means responsive to the temperature of the aerated, gaseous fuel fluid delivered from the mixing chamber, and more specifically, inversely related thereto.

Means may be provided for preventing backflow of fuel fluid into the heat exchanger.

Thus, the invention comprehends the provision of an apparatus which provides an aerated, gaseous fuel fluid from a liquid fuel fluid eliminating the need for a separate externally energized vaporizer and thereby providing optimum efficiency in the provision of the desired fuel. The apparatus includes means for automatically regulating the fluid flows so as to provide a preselected calorific value fuel with means for adjusting the preselected value as desired.

In another specific embodiment, the means for utilizing waste heat from the air compressing means comprises a flash tube and heat exchanger cascaded with the flash tube and heat exchanger structure provided for use in dehumidifying the compressed air. In this arrangement, the size of the vaporizer is effectively reduced thereby reducing the overall cost of the apparatus while yet providing improved efficiency in the provision of the gaseous fuel fluid from the liquid fuel fluid.

The cascaded arrangement provides a controlled amount of superheat with effectively positive mixing of the compressed air and vaporized fuel to provide further improved control system characteristics. More specifically, the invention comprehends the provision of apparatus for providing from a supply of liquid fuel fluid a gaseous fuel fluid including compressor means for providing compressed air, means for dehumidifying the compressed air, means for mixing liquid fuel fluid with the dehumidified air to form an aerated fuel fluid, means for flashing additional fuel fluid into the aerated fuel fluid to provide a low temperature resultant fuel fluid, and means for transferring heat from the compressor means to the resultant fuel fluid to form gaseous fuel fluid.

The apparatus is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figures 1, 2:
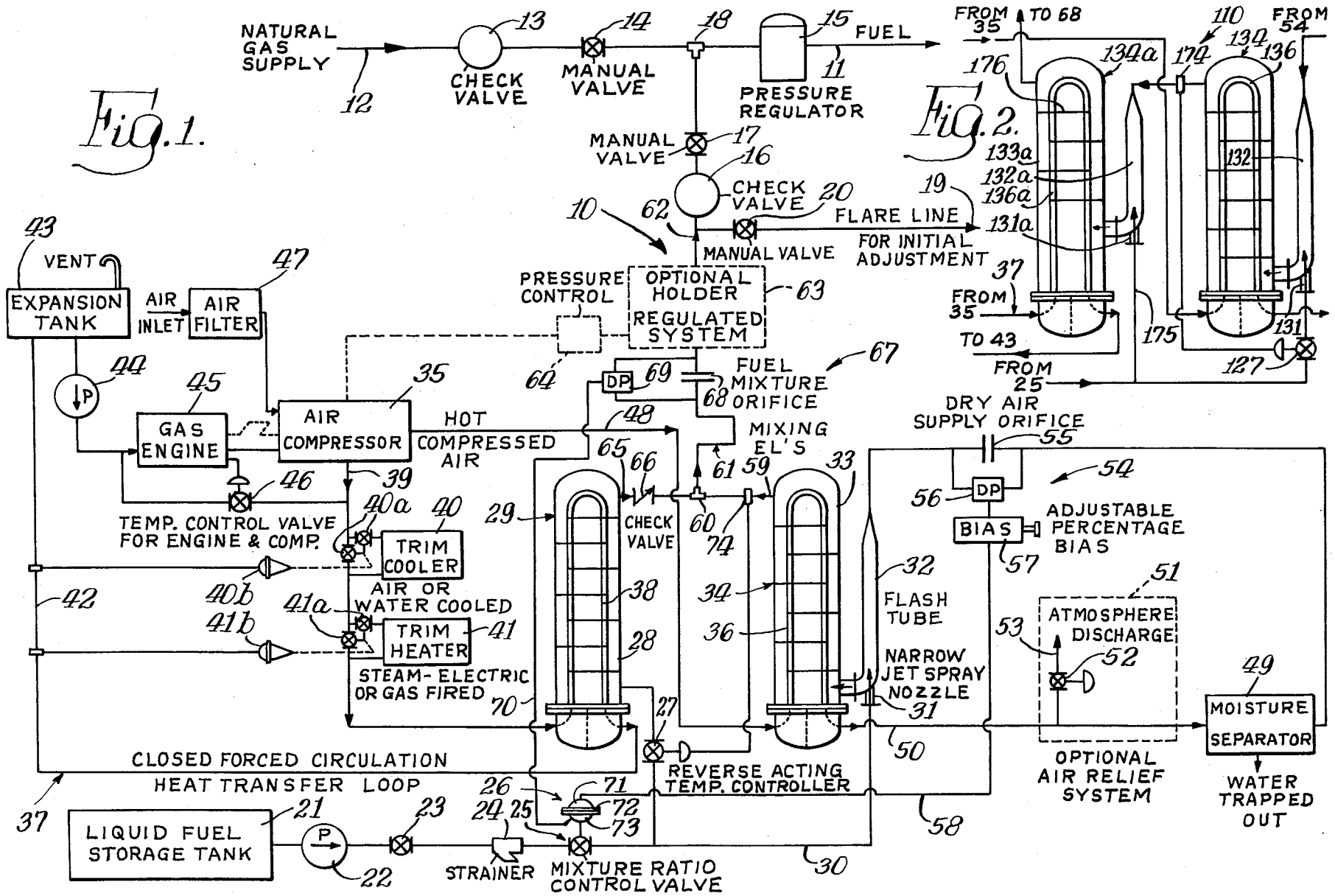
FIG. 1 is a schematic flow diagram of a fuel-providing apparatus embodying the invention.
FIG. 2 is a fragmentary schematic flow diagram of a modified form of fuel-providing apparatus embodying the invention.

In the exemplary embodiment of the invention as disclosed in FIG. 1 of the drawing, an apparatus generally designated 10 is provided for delivering an aerated, gaseous fuel fluid to a fuel demand delivery point 11 for supplementation or replacement of fuel fluid from a natural gas supply 12. The natural gas fuel fluid may be provided to the demand point 11 through a conventional check valve 13, manual control valve 14, and pressure regulator 15 in the customary manner. Fuel fluid from apparatus 10 may be provided therefrom through a check valve 16, a manual control valve 17, and a suitable connector 18 to the main gas supply line upstream of the pressure regulator 15. A flare line 19 may be provided for initial adjustment of the delivery of fuel fluid from apparatus 10 at start-up and may be suitably controlled by a manual valve 20.

Liquid fuel is delivered to apparatus 10 from a suitable supply, such as storage tank 21, by means of a liquid pump 22, a manual control valve 23, and a suitable strainer 24. The rate of flow of the liquid fuel from supply 21 is controlled by a mixture ratio control valve 25 having a diaphragm operator 26. One portion of the liquid fuel is delivered from valve 25 through a temperature controlled valve 27 to the shell 28 of a tube and shell heat exchanger generally designated 29. A second portion of the liquid fuel is delivered through a conduit 30 to a jet spray nozzle 31 into a flash tube 32 opening into the shell 33 of a tube and shell heat exchanger 34.

A substantial portion of the liquid fuel sprayed into the flash tube is vaporized in a body of compressed air delivered thereto from an air compressor 35. The resultant low temperature aerated fuel mixture is utilized to cool the compressed air delivered from compressor 35 through the tube portion 36 of heat exchanger 34.

In the present embodiment, the waste heat from the air compressing means is utilized to vaporize a portion of the liquid fuel in the heat exchanger 29. For this purpose, a suitable coolant is circulated through a closed heat transfer loop generally designated 37 which includes the tube portion 38 of the heat exchanger 29. More specifically, the closed loop 37 includes a delivery conduit 39 optionally provided with a trim cooler 40 and a trim heater 41 for adjusting the temperature of the coolant delivered to the heat exchanger tube portion 38. Suitable valves 40*a* are associated with trim cooler 40 and 41*a* associated with trim heater 41 for selectively passing the coolant therethrough as required. Valves 40*a* and 41*a* may be thermostatically controlled by operators 40*b* and 41*b*, respectively, connected to a return line portion 42 of the closed loop system.

Coolant is delivered through return line 42 from heat exchanger 29 through a vented expansion tank 43 and a suitable pump 44 to cool the gas engine 45 and air compressor 35. A temperature controlled valve 46 may be provided for the temperature of the coolant system. Ambient air may be delivered to the air compressor 35 by a conventional air filter 47, as shown.

Thus, in operation of apparatus 10, a portion of the liquid fuel fluid is delivered through valve 27 into shell 28 of heat exchanger 29 wherein it is vaporized as a result of heat exchange with the coolant circulated through tubes 38 of the heat exchanger 29 from the air compressor 35 and gas engine 45.

The hot compressed air is delivered through a conduit 48 to the tube portion 36 of heat exchanger 34 to be cooled therein sufficiently to dehumidify the air by permitting the condensed moisture to be separated from the air by means of a conventional moisture separator 49 connected to the outlet 50 of tube portion 36. As shown in the drawing, an optional air relief system generally designated 51 may be provided in the form of a manually adjustable valve 52 for venting the compressed air through a suitable vent duct 53 to atmosphere.

The dehumidified cooled air is delivered into the flash tube 32 through a flow rate responsive means generally designated 54 which includes an orifice 55, a differential pressure sensing means 56, and a manually adjustable percentage bias regulator 57 connected to the diaphragm operator 26 of valve 25 through a conduit 58.

As discussed above, a portion of the liquid fuel is injected into the dry compressed air in flash tube 32 whereby it vaporizes in accordance with the partial pressure laws. The vaporization lowers the temperature thereof so that the resultant aerated vaporized fuel fluid serves as a low temperature heat exchange medium in flowing through shell 33 to an outlet 59 thereby serving as the means for cooling the hot compressed air flowed through the tube portion 36 of the heat exchanger 34. Outlet 59 of heat exchanger 34 may be connected to a T-connector 60 for delivering the aerated, gaseous fuel fluid through a mixing el 61 to the outlet 62 of apparatus 10. An optional holding tank 63 may be provided upstream of outlet 62 and may have associated therewith a pressure control 64 for regulating the operation of compressor 35 as desired.

The fuel vaporized in shell 28 of heat exchanger 29 is delivered therefrom through an outlet 65 and a check valve 66 to connector 60 for mixing with the aerated, gaseous fuel fluid from heat exchanger 34 in the mixing el 61.

A second flow rate control device generally designated 67 is provided between mixing el 61 and outlet 62, herein comprising a fuel mixture orifice 68, and a differential pressure sensing means 69 connected in series through a conduit 70 to the diaphragm operator 26 of valve 25.

In the illustrated embodiment, conduit 58 leading from flow rate responsive means 54 is connected to the upper portion 71 of operator 26 above diaphragm portion 72 thereof, and conduit 70 is connected to the lower portion 73 of operator 26 below diaphragm portion 72 to provide a counterbalancing action in controlling the mixture ratio control valve 25.

More specifically, apparatus 10 is arranged to utilize available waste heat in the air compressing operation to provide substantially the entire requirement for energy of vaporization of the liquid fuel in providing the desired preselected calorific value aerated, gaseous fuel. This operation of the apparatus is related to the system operating pressure, the gas engine and air compressor operating efficiencies, the ambient air and the conditions thereof. More specifically, with high operating pressures and relatively high humidity, the air cooling and dehumidification operation utilizes approximately one-fourth of the total heat required for vaporization. The gas engine and air compressor waste heat which may include lube oil cooling, exhaust silencer cooling of the engine, and lube oil cooling of the compressor with air intercooling where the compressor is a high pressure compressor, will provide approximately three-fourths of the heat requirement for the vaporization of the liquid fuel. By utilization of the closed loop 37 in transferring heat energy from the gas engine and air compressor to the liquid fuel, substantially 100 percent of the waste heat may be utilized in vaporizing the fuel in heat exchanger 29. Resultingly, a base load propane-air blend provided by apparatus 10 may be less expensive to provide than cracking propane into lighter hydrocarbons (SNG) for injection into the gas supply.

Further, as discussed above, the present apparatus provides an automatic control of the calorific value of the aerated gaseous fuel. More specifically, the controls 54 and 67 utilize the pressure drops across conventional orifice means to provide pressure signals controlling the operation of the operator of control valve 25. In the illustrated embodiment, orifice 55 may be suitably designed to provide a drop of 1 to 2 inches of water at minimum turn-down conditions in the apparatus. Orifice 68 is desired to have substantially the same Reynolds number as orifice 55 at the expected design ratio of gaseous fuel fluid and air. Resultingly, the orifice coefficients are substantially identical at all ranges of flow therethrough in the normal operation of the apparatus so as to provide accurate correlation between the rates of flow over the entire intended range.

As will be obvious to those skilled in the art, the signals obtained from the orifices are proportional to the square of the fluid flow therethrough. Thus, the signal applied to the top of diaphragm 72 from orifice 55 is directly proportional to the rate of flow of the dry air to the flash tube 32 and the signal applied to the bottom of the diaphragm 72 by the orifice 68 is directly proportional to the rate of flow of the fuel mixture delivered from the mixing el 61. To provide an adjustment in the calorific value of the fuel as desired, a constant adjustment in the pressure signal delivered from at least one of the orifices 55 and 68 may be provided, and in the illustrated embodiment, adjustment of the signal from orifice 55 is provided by means of the adjustable percentage bias means 57.

In the operation of the apparatus, the coolant liquid, which may comprise a conventional 50% ethylene glycol and water mixture, provides sufficient heat to vaporize the liquid fuel in shell 28 and to provide some superheating thereof. The thermostat valve 46 regulates the engine temperature. The trim cooler 40 and trim heater 41 are utilized selectively depending on the operating conditions. Thus, the cooler may be utilized if a surplus of heat is expected in the operation of the gas engine and air compressor or where the fuel demand requires minimal operation of the fuel injection means 31 and 32. Both devices may be utilized to maintain the operating conditions accurately at a preselected value if desired. As indicated above, the trim cooler and trim heater are thermostatically controlled by three-way linked valves **40*b* and 41*b* responsive to the temperature of the coolant being returned from the heat exchanger 29.**

Expansion valve 43 provides for venting air from the system and to accommodate expansion of the coolant as it is heated in the normal operation of the apparatus. The use of the expansion tank further prevents cavitation of the pump 44 providing the forced circulation of the coolant in the closed loop 37. The compressed air is cooled to a temperature of substantially 37° F. in heat exchanger 29 so as to be at the saturation point permitting the moisture to be separated readily in separator 49. The air, as discussed above, is further cooled in flash tube 32 by the action of the liquid fuel jet spray therein as a result of the partial pressure conditions. As shown in the drawing, the spray is directed in counterflow relationship to the air flow through the flash tube so as to provide maximum vaporization. The relatively low temperature fuel-air mixture provides the desired heat exchange with the incoming hot compressed air in tube 36 to chill the air to the saturation point, as discussed above. Any liquid fuel carried into shell 33 is vaporized by the warm tubes 36. Heat exchanger 34 is arranged to cause the aerated, gaseous fuel fluid leaving shell 33 at outlet 59 to be superheated to approximately 32° F. The exact temperature of the fluid at outlet 59 is sensed by a temperature sensor 74 which controls the valve 27 comprising a reverse acting temperature controller so that the higher the temperature sensed by temperature sensing device 74 the lower the rate of flow of liquid fuel through valve 27 into heat exchanger 29, and vice versa.

Resultingly, the output fuel mixture is a combination of the aerated, gaseous fuel delivered from the chiller heat exchanger 34 and the vaporized fuel delivered from the vaporizer heat exchanger 29. Check valve 66 prevents reverse flow into shell 28 of heat exchanger 29 during an upset condition. The mixed flow of the vaporized fuel from heat exchanger 29 and aerated, gaseous fuel from heat exchanger 34 is smoothed out by the mixing el 61 prior to the delivery through the control orifice 68.

As indicated above, a flare line 19 may be provided for use during initial start-up of the apparatus. Similarly, suitable gauges may be connected to the flare line for determining the actual calorific value of the mixed aerated fuel being delivered to the delivery point 11. The calorific value may be readily manually adjusted by means of the bias means 57, as discussed above, to cause the fuel delivery to have a preselected desired value. Check valve 16 effectively prevents backflow of natural gas into apparatus 10.

Thus, apparatus 10 obviates the need for an external vaporizer, thereby effectively maximizing the operating efficiency of the apparatus. Substantially all of the waste heat from the air compressing means is effectively utilized in vaporizing a portion of the liquid fuel and vaporization of another portion of the fuel is effected in providing desired moisture separation from the supply air. The control of the calorific value is extremely simple and economical while yet providing improved regulation as compared with that provided by conventional fuel supply systems. Maintenance costs are effectively minimized by minimizing moving parts in the apparatus and eliminating the need for an external vaporizing means. The entire apparatus may be mounted as a package on a single base for facilitated installation.

The heat exchanger 34 may be utilized as an air stabilization means without the use of the vaporizer heat exchanger 29.

Turning now to the embodiment of FIG. 2, a modified form of apparatus generally designated 110 is shown to comprise an apparatus generally similar to apparatus 10 but having a modified arrangement of the air compressor cooling means heat exchanger in association with the compressed air dehumidification means heat exchanger.

Thus, as shown in FIG. 2, apparatus 110 comprises a cascaded arrangement of a second flash tube **132*a* and heat exchanger 134*a* with the compressed air dehumidification means flash tube 132 and heat exchanger 134. The structure of FIG. 2 is adapted for use at relatively high pressures where the saturated temperature of the fuel fluid approaches the heat sink conditions of the air compressor heat transfer loop 37. Broadly, apparatus 10 functions to deliver the output of heat exchanger 134 comprising an aerated fuel fluid resulting from the injection of liquid fuel fluid into the compressed air in flash tube 132 and the subsequent heat exchange thereof with the incoming compressed air in the tube portion 136 of heat exchanger 134, to the second flash tube 132***a* where additional liquid fuel fluid is flashed thereinto for further chilling of the air and fuel mixture and providing a lower temperature heat exchange medium for removing heat from the air compressor loop 37.

Thus, as shown in FIG. 2, a liquid fuel is delivered from the mixture ratio control valve 25 with one portion being delivered to the flash tube 132 through the temperature controlled valve 127 which responds to the temperature of the aerated fuel fluid delivered from heat exchanger 134 as sensed by the control 174 to regulate the delivery of liquid fuel fluid through the jet 131 to the flash tube 132. Heat exchanger 134 functions somewhat similarly to heat exchanger 34 in apparatus 10 in cooling the compressed air delivered from the air compressor 35 for suitable dehumidification thereof before delivery to the flash tube 132. The aerated fuel fluid delivered from heat exchanger 134 is thusly similar to the aerated fuel fluid delivered from heat exchanger 34 to the delivery connection 60. In the embodiment of FIG. 2, however, the aerated fuel fluid is delivered through the second flash tube 132*a* and heat exchanger 134 to provide a second heat exchange operation prior to the delivery thereof to the fuel mixture orifice 68. In the second heat exchange operation, the low temperature condition obtained by the flashing of additional liquid fuel fluid is utilized to provide an improved transfer of heat from the air compressing means loop 37 thereby further improving the efficiency of the overall apparatus.

As shown in FIG. 2, a second portion of the liquid fuel fluid is delivered through a conduit 175 to a jet spray nozzle 131*a* for spraying the liquid fuel fluid into the stream of aerated fuel fluid flowing concurrently through the flash tube 132*a* from heat exchanger 134. The resultant fuel fluid is then passed through the shell 133*a* to have heat exchange relationship with the tube 134 carrying the coolant in the air compressor cooling loop 37.

Heat exchanger 134*a* thusly functions as a two-phase inlet system in that both the fluid resulting from the flashing of additional liquid fuel into the aerated fuel fluid, and some liquid fuel is delivered into the lower portion of the shell 133*a*. The fluid leaving the shell 133*a* comprises a single phase gaseous fuel fluid having a superheat of approximately 25° F. on the fuel portion of the mixture. The superheat temperature is controlled by the temperature conditions of the coolant in the heat transfer loop 37 thus providing load control and effectively minimizing the need for the trim cooler 40 and trim heater 41.

Illustratively, where the fuel comprises propane and is to be delivered at a pressure of approximately 170 p.s.i.g. with a 53% propane ratio in the gaseous fuel fluid, the use of the cascading system permits a reduction in the heat transfer surface of the heat exchanger 134*a* to about half that of the surface required in the liquid heat exchange system of apparatus 10.

Further, the utilization of the jet spray means 131*a* and flash tube 132*a* provides for improved mixing of the additional liquid fuel providing further improved operating characteristics of the apparatus 110.

Similarly to jet spray 131, jet spray 131*a* preferably comprises a narrow angle spray nozzle which, as indicated above, directs the sprayed liquid fuel fluid in counterflow relationship to the aerated fuel fluid being delivered through the flash tube 132*a* thereby providing improved retention time for scrubbing of the sprayed liquid with the gas. The flashing of the liquid fuel in flash tube 132*a* not only cools the resultant gaseous fuel fluid, but further cools the portion which remains liquid and is delivered with the gaseous fluid into the heat exchanger shell 133*a*. In normal operating conditions, the cooling may be in the order of 8° to 20° F.

The liquid fuel delivered into shell 133*a* is vaporized by contact with the tube 136*a* carrying the hot coolant liquid in the air compressor coolant loop 37. The vaporized fuel mixes with the aerated fuel fluid delivered from the flash tube and is then delivered from the shell 133*a* through the fuel mixture orifice 68 as the output gaseous fuel fluid. As is conventional in heat exchange construction, the heat exchanger shell may be provided with suitable baffles 176 for further mixing and superheating the blended gaseous fluid in the heat exchanger 134*a* before delivery therefrom.

The control of mixture ratio control valve 25 in the apparatus 110 is similar to that in apparatus 10 in that the valve is controlled by means 54 sensing the rate of flow of compressed air to flash tube 132 and means sensing the rate of flow of the output gaseous fuel fluid through the fuel mixture orifice 68. Thus, in all respects other than those discussed above relative to apparatus 110, apparatus 110 is similar to and functions similar to apparatus 10. However, by providing the improved lower temperature heat exchange condition in transferring the heat from the air compressor coolant loop 37, the improved efficiency and reduced capital cost discussed above are realized. Further, by reducing the size of the heat exchangers, the apparatus may be mounted on a common base with short interconnections between the elements of the system.

The foregoing disclosure of specific embodiments is illustrative of the broad inventive concepts comprehended by the invention.

I claim:

1. Apparatus for providing from a supply of vaporizable liquid fuel fluid a gaseous fuel fluid having a preselected calorific value, comprising:

means defining a mixing chamber;

means for providing a flow of mixing air to said mixing chamber;

means providing a flow of liquid fuel fluid from said supply to said mixing chamber for vaporizing the liquid fuel fluid therein to form with the mixing air therein as aerated gaseous fuel fluid;

first control means operable as a function of the rate of flow of said mixing air to said chamber to vary the rate of flow of said liquid fuel fluid to said chamber;

means for conducting the gaseous fuel fluid from said mixing chamber;

second control means operable as a function of the rate of flow of aerated gaseous fuel fluid conducted from said mixing chamber for inversely varying the rate of said flow of liquid fuel fluid to said chamber; and adjustable means for adjusting a signal from at least one of the control means for adjusting the ratio between said mixing air rate of flow and said gaseous fuel fluid rate of flow.

2. The apparatus of claim 1 wherein said adjustable means comprises means for selectively adjusting the control of said rate of flow of liquid fuel fluid by said first control means.

3. The apparatus of claim 1 wherein said first and second control means comprise first and second orifice means responsive respectively to the rates of flow of said mixing air and gaseous fuel fluid to provide pressure differential signals, and said liquid fuel fluid providing means includes flow regulating means responsive to said pressure signals to vary said rate of flow of the liquid fuel fluid to said chamber.

4. The apparatus of claim 1 wherein said first and second control means comprise first and second orifice means responsive respectively to the rates of flow of said mixing air and gaseous fuel fluid to provide pressure differential signals, and said liquid fuel fluid providing means includes diaphragm valve means responsive to said pressure signals to vary said rate of flow of the liquid fuel fluid to said chamber.

5. The apparatus of claim 1 wherein said first and second control means comprise first and second orifice means responsive respectively to the rates of flow of said mixing air and gaseous fuel fluid to provide pressure differential signals, and said liquid fuel fluid providing means includes flow regulating means responsive to said pressure signals to vary said rate of flow of the liquid fuel fluid to said chamber, said first and second orifice means being preselected to have substantially the same Reynold's value at a preselected calorific value of said aerated gaseous fuel fluid.

6. The apparatus of claim 1 wherein said first and second control means comprise first and second orifice means responsive respectively to the rates of flow of said mixing air and gaseous fuel fluid to provide pressure differential signals, said adjustable mens comprises means for adding an adjustable bias signal to the differential pressure signal provided by at least one of said orifice means, and said liquid fuel fluid providing means includes flow regulating means responsive to said pressure signals as adjusted to vary said rate of flow of the liquid fuel fluid to said chamber.

7. The apparatus of claim 1 wherein said first and second control means comprise first and second orifice means responsive respectively to the rates of flow of said mixing air and gaseous fuel fluid to provide pressure differential signals, said adjustable means comprises means for adding an adjustable bias signal to the differential pressure signal provided by said first control means orifice means, and said liquid fuel fluid providing means includes flow regulating means responsive to said pressure signals as adjusted to vary said rate of flow of the liquid fuel fluid to said chamber.

8. The apparatus of claim 1 wherein each of said control means comprise means operable as a function of the square of the rate of flow.

9. The apparatus of claim 1 further including means for introducing a nonaerated gaseous fuel fluid from said liquid fuel fluid supply into said aerated gaseous fuel fluid prior to delivery thereof to said second control means.

10. The apparatus of claim 1 further including means for introducing a nonaerated gaseous fuel fluid from said liquid fuel fluid supply into said aerated gaseous fuel fluid prior to delivery thereof to said second control means, and means for preventing back-flow of aerated gaseous fuel fluid through said introducing means.

11. The apparatus of claim 1 further including heat transfer means for transferring heat from said air providing means, means for introducing a nonaerated gaseous fuel fluid from said liquid fuel fluid supply into said aerated gaseous fuel fluid prior to delivery thereof to said second control means, said introducing means comprising a tube and shell heat exchanger portion of said heat transfer means wherein the liquid fuel fluid is vaporized by said heat from the air providing means.

12. The apparatus of claim 1 further including heat transfer means for transferring heat from said air providing means, means for introducing a nonaerated gaseous fuel fluid from said liquid fuel fluid supply into said aerated gaseous fuel fluid prior to delivery thereof to said second control means, said introducing means comprising a tube and shell heat exchanger portion of said heat transfer means wherein the liquid fuel fluid is vaporized by said heat from the air providing means, and means responsive to the temperature of the aerated gaseous fuel fluid leaving said mixing chamber means for controlling the rate of flow of liquid fuel fluid from said supply to said heat exchanger.

13. Apparatus for providing from a supply of liquid fuel fluid a gaseous fuel at a delivery position comprising:

a heat exchanger having a heat exchange tube within a shell thereof;

air compressing means having cooling means;

means for delivering liquid fuel fluid from said supply to said heat exchanger;

means providing a closed loop flow of fluid coolant between said air compressing means and said heat exchanger to be cooled by heat exchange with liquid fuel fluid in the heat exchanger to vaporize liquid fuel fluid therein and thusly form a vaporized fuel fluid and for returning the cooled coolant to the air compressing means for subsequent cooling of the air compressing means; and means for mixing additional liquid fuel fluid with air compressed by said air compressing means to provide an aerated gaseous fuel fluid to said delivery position, said heat exchanger including means for directing said fluid coolant through the tube thereof and directing said liquid fuel fluid into the shell thereof, said shell having an outlet for directing vaporized fuel fluid outwardly therefrom to said delivery position, and means for preventing reverse flow of fluid through said outlet into said shell.

14. The apparatus for providing from a supply of liquid fuel fluid a gaseous fuel of claim 13 further including means for adjusting the temperature of the coolant delivered from the compressing means to said heat exchanger.

15. Apparatus for providing from a supply of liquid fuel fluid a gaseous fuel comprising: a heat exchanger having a heat exchange tube within a shell thereof; air compressing means having cooling means; delivery means for delivering liquid fuel fluid from said supply to said heat exchanger; means providing a closed loop flow of fluid coolant between said air compressing means and said heat exchanger for heat exchange with fuel fluid in the heat exchanger and return to the cooled coolant to the air compressing means for subsequent cooling of the air compressing means; means for mixing additional liquid fuel fluid with air comprising aerating means for flashing said additional liquid fuel fluid into the air compressed by said compressing means to form an aerated fuel fluid; flow control means responsive to the temperature of said aerated fuel fluid to adjust the rate of flow of liquid fuel fluid to said heat exchanger; and means for combining fuel fluid from said heat exchanger with aerated fuel fluid from said aerating means to form said gaseous fuel.

16. The apparatus for providing from a supply of liquid fuel fluid a gaseous fuel of claim 15 wherein said flow control means is arranged to vary the flow of liquid fuel fluid inversely to a change in said temperature of the aerated fuel fluid.

17. The apparatus for providing from a supply of liquid fuel fluid a gaseous fuel of claim 15 wherein the liquid fuel fluid delivery means includes valve means for delivering liquid fuel to said heat exhanger.

18. Apparatus for providing from a supply of liquid fuel fluid a gaseous fuel comprising: air compressing means for providing compressed air; means for cooling the compressed air including means for flashing liquid fuel fluid into the compressed air to form an aerated fuel fluid; first heat exchanger means for causing the aerated fuel fluid to cool additional compressed air delivered from said air compressing means prior to flashing of the liquid fuel fluid thereinto; means for flashing additional liquid fuel fluid into the aerated fuel fluid to form a combination of the aerated fuel fluid and flashed additional liquid fuel fluid; second heat exchanger means for causing said combination fuel fluid to cool the air compressing means; and means for delivering the resultant fuel fluid combination from said second heat exchanger means.

19. The apparatus for providing from a supply of liquid fuel fluid a gaseous fuel of claim 18 wherein said second heat exchanger means defines a heat exchange tube within a shell, coolant fluid circulating means in heat transfer association with said air compressing means and providing a circulation of coolant fluid through the tube of said second heat exchanger means, and means for directing said fuel fluid combination through said shell in heat exchange relationship with the coolant fluid circulating through said tube.

20. Apparatus for providing from a supply of liquid fuel fluid a gaseous fuel comprising: compressor means for providing compressed air; means for dehumidifying the compressed air; means for mixing liquid fuel fluid with the dehumidified air to form an aerated fuel fluid; and means for flashing additional liquid fuel fluid into the aerated fuel fluid to provide a low temperature fuel fluid combination; and heat exchanger means for transferring heat from said compressor means to said fuel fluid combination to form said gaseous fuel.

21. The apparatus for providing from a supply of liquid fuel fluid a gaseous fuel of claim 20 wherein said means for mixing liquid fuel fluid with the dehumidified air comprises means for flashing a portion of the liquid fuel fluid into the dehumidified air.

22. The apparatus for providing from a supply of liquid fuel fluid a gaseous fuel of claim 20 wherein said mixing means comprises means defining a mixing chamber means, means for flowing the compressed air to said mixing chamber means, means for flowing liquid fuel fluid to said mixing chamber means, and means responsive to the temperature of the aerated fuel fluid for controlling the rate of delivery of liquid fuel fluid to the mixing chamber means.

23. The apparatus for providing from a supply of liquid fuel fluid a gaseous fuel of claim 20 wherein said mixing means comprises means defining a mixing chamber means, means for flowing the compressed air to said mixing chamber means, means for flowing liquid fuel fluid to said mixing chamber means, first mixture ratio control means operable as a function of the rate of flow of said compressed air to said mixing chamber means to vary the rate of flow of said liquid fuel fluid to said mixing chamber means, second mixture ratio control means operable as a function of the rate of flow of gaseous fuel fluid from said heat transferring means to inversely vary the rate of flow of said liquid fuel fluid to said mixing chamber means, and adjustable means for adjusting the ratio between said air rate of flow and said liquid fuel fluid rate of flow.

* * * * *